US006554645B1

(12) United States Patent
Boemmel et al.

(10) Patent No.: US 6,554,645 B1
(45) Date of Patent: Apr. 29, 2003

(54) PRIMARY TERMINAL RETENTION FEATURE FOR CONNECTORS

(75) Inventors: Christian Otto Boemmel, Langen (DE); Rolf Jetter, Darmstadt (DE)

(73) Assignee: AMP Deutschland GmbH, Langen (DE)

( * ) Notice: Subject to any disclaimer, the term of this patent is extended or adjusted under 35 U.S.C. 154(b) by 0 days.

(21) Appl. No.: 09/620,151

(22) Filed: Jul. 20, 2000

(30) Foreign Application Priority Data

Jul. 21, 1999 (EP) ..... 99114370

(51) Int. Cl.[7] ..... H01R 13/40
(52) U.S. Cl. ..... 439/595
(58) Field of Search ..... 439/595, 744, 439/871, 353, 354

(56) References Cited

U.S. PATENT DOCUMENTS 3,781,760 A * 12/1973 Mancini et al. ..... 439/595
3,805,219 A * 4/1974 Bright ..... 439/744
4,776,816 A * 10/1988 Herscovici et al. ..... 439/744
4,988,316 A * 1/1991 Roy ..... 439/744
5,122,080 A 6/1992 Hatagishi ..... 439/595
5,186,658 A * 2/1993 Kikuchi et al. ..... 435/595
5,653,613 A 8/1997 Shimoda ..... 439/752
5,755,600 A 5/1998 Yoshida ..... 439/752
5,944,557 A * 8/1999 Fukuda ..... 439/595

FOREIGN PATENT DOCUMENTS

EP 0 895 312 2/1999
JP 10003972 1/1998

OTHER PUBLICATIONS

European Search Report Mar. 1, 2002.

* cited by examiner

*Primary Examiner*—Javaid Nasri

(57) ABSTRACT

A connector for receiving terminals therein that includes a terminal block having outer side walls and opposing end walls, wherein terminal receiving passageways extend between the opposing end walls for receiving a terminal, and a primary retention member is disposed along at least one of the terminal receiving passageways that includes a resilient retention arm that extends into the passageway to retain the terminal therein, where the primary retention member is particularly adapted to situations where the spacing between the wall and the passageway is relatively small.

10 Claims, 7 Drawing Sheets

PRIMARY TERMINAL RETENTION FEATURE FOR CONNECTORS

BACKGROUND OF THE INVENTION

This invention relates to terminal retention in connectors and particularly primary terminal retention.

DESCRIPTION OF THE PRIOR ART

In connectors, it is common to have a primary terminal retention feature that retains the individual terminals in their respective terminal passageways. Connectors typically hold a plurality of terminals, this primary retention feature enables each terminal to be held in place once loaded into the connector while the other terminals are being loaded in their respective passageways. In high vibration environments or in applications where it is likely that there may be additional forces excerpted on the terminal that tend to dislodge the terminal from the terminal receiving passageway, it is also common to incorporate a secondary locking member as part of the connector assembly. A common form of a secondary locking member involves a structure having a shoulder that is moveable into the passageway in order to provide an obstruction therealong would interfere with a complementary shoulder on the contact and thereby prevent withdraw.

An example of an electrical connector of this type is illustrated in EP 0 510 583 where a generally rectangular terminal block has a number of electrical terminal receiving cavities with primary connection means disposed along the longer sides of the terminal block and corresponding to each of the respective cavities in order to retain the electrical terminals therein. The primary connecting means are integrally moulded resilient arms having a latching tab thereupon to engage the contact when it is inserted. Additionally, a secondary locking structure is provided by a flexible hinged flap having a plurality of comb-like teeth thereupon which extend through holes in the terminal block and into the passageway to obstruct the passageways, thereby preventing the terminal from being removed from the terminal block.

In general, there is trend toward reducing the size of connectors. For various reasons, it may not be possible to reduce the spacing between the terminals positioned within the connector. Therefore, it is desirable to minimise the outside profile of the terminal block. This presents a number of problems to connectors such as that disclosed in the aforementioned reference. First of all, as the outer profile becomes smaller, the wall in which the primary retention means is disposed becomes thinner. This makes it difficult to form the integrally moulded latch arm. Additionally, when a primary retention arm and an opening for secondary locking is provided the structural integrity of the terminal block is reduced.

Therefore, it is desirable to improve upon the existing connectors by providing effective primary terminal retention in terminal blocks having thin walls. It is a problem with connectors such as that disclosed above to provide primary terminal retention in generally rectangular connectors where the longitudinally extending walls are close to the terminal passageways so that it is not easily to form primary connecting means therein. It is a problem with connectors as disclosed in the aforementioned reference that as the wall becomes thinner, the amount of material available for the forming of the resilient arm with the latch thereupon is reduced, these primary retention members become susceptible to overstress damage and it s desirable to prevent such failure.

It is important to note however that while the aforementioned reference is directed to an electrical connector and that is the most common application of connectors, the problems set out above also apply to fibre optic connectors and the present invention is applicable to connectors in general. The terminals described herein are meant to be generic and could be either for the termination of optical or electrical cables.

SUMMARY OF THE INVENTION

At least the first problem set out above is solved by providing a connector for receiving terminals therein, the connector comprising a terminal block having outer walls and opposing ends walls, a terminal receiving passageway extending between the opposing end walls for receiving a terminal therein, and a primary retention member disposed along the passageway having a resilient retention arm extending into the passageway to retain their terminal therein, the connector being characterised in that the primary retention member is formed from a generally flat plate and includes a body set in the terminal block and the retention arm extends from the body into the passageway.

At least the second problem set out above is solved by providing a connector for receiving terminal therein, the connector comprising a terminal block having outer side walls that intersect to define corners and opposing end walls, a terminal receiving passageway extending between the opposing end walls for receding a terminal therein, and a primary retention member disposed along at least one of the terminal receiving passageways and having resilient retention arm extending into the passageway to retain the terminal therein, where the at least one passageway is located in the vicinity of one of the corners, the connector is characterised in that primary retention member is disposed between the one of the corners and the one passageway in the vicinity of the corner.

At least the third problem set out above is solved by providing a connector for receiving terminals therein, the connector comprising a terminal block having outer side walls and opposing end walls with terminal receiving passageways extending therethrough, primary retention members are disposed along respective passageways and include an moulded resilient latch arm formed integrally with terminal block that extends into the passageway to prevent withdraw of the inserted terminal, the connector characterised in that the terminal block includes a post located behind the resilient latch arm to prevent overstress.

It is an advantage of the present invention that an effective primary retention of terminals in a terminal block may be achieved even when the walls adjacent the terminal receiving passageways are relatively close thereto. It is yet another advantage of the invention that the primary retention member may be stamped and formed from a thin sheet of metal. It is another advantage of the invention that by providing a primary retention member in the vicinity of the corner, additional material of the terminal block is available in order to establish the primary retention. It is another advantage of the invention that by providing a post behind a resilient latch arm of the primary retention member to prevent overstress, smaller latch arms may be used.

It is still yet another advantage that secondary locking may be included in a connector of this type. In particular, it is possible to incorporate a secondary locking member upon a cover as set out in one of the alternative embodiments.

BRIEF DESCRIPTION OF THE DRAWINGS

FIG. 8 is a bottom perspective view of a cover for the connector illustrated in FIG. 6.

DETAILED DESCRIPTION OF THE PREFERRED EMBODIMENT

Figure 1:
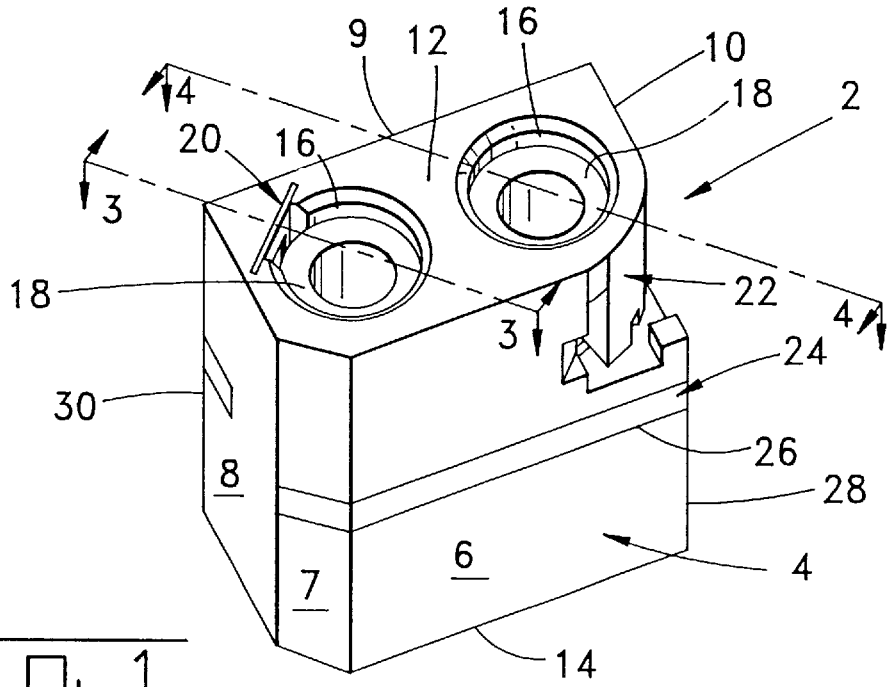
FIG. 1 is an upper perspective view of an electrical connector incorporating the present invention.

With reference now to FIG. 1, a connector incorporating the present invention is shown generally at 2. The connector 2 includes a terminal 4 having outer walls 6, 7, 8, 9, 10 and opposing end walls 12, 14. A pair of terminal receiving passageways 16 extend through the terminal block 4 between he opposing end walls 12, 14. Disposed in these terminal receiving passageways 16 are terminals 18. As mentioned above, these terminals 18 are meant to be generic in nature and could represent either fibre optic or electrical terminals. Respective primary retention members 20, 22 are disposed along the passageways for retaining the terminals 18 therein. Additionally, a secondary locking member 24 is received within a slot 26 that extends transversely across the terminal block 4 relative to the passageways 16. Additionally, it can be seen that side walls 6 and 10 define a corner 28 and side walls 8 and 9 define a corner 30.

Figure 2:
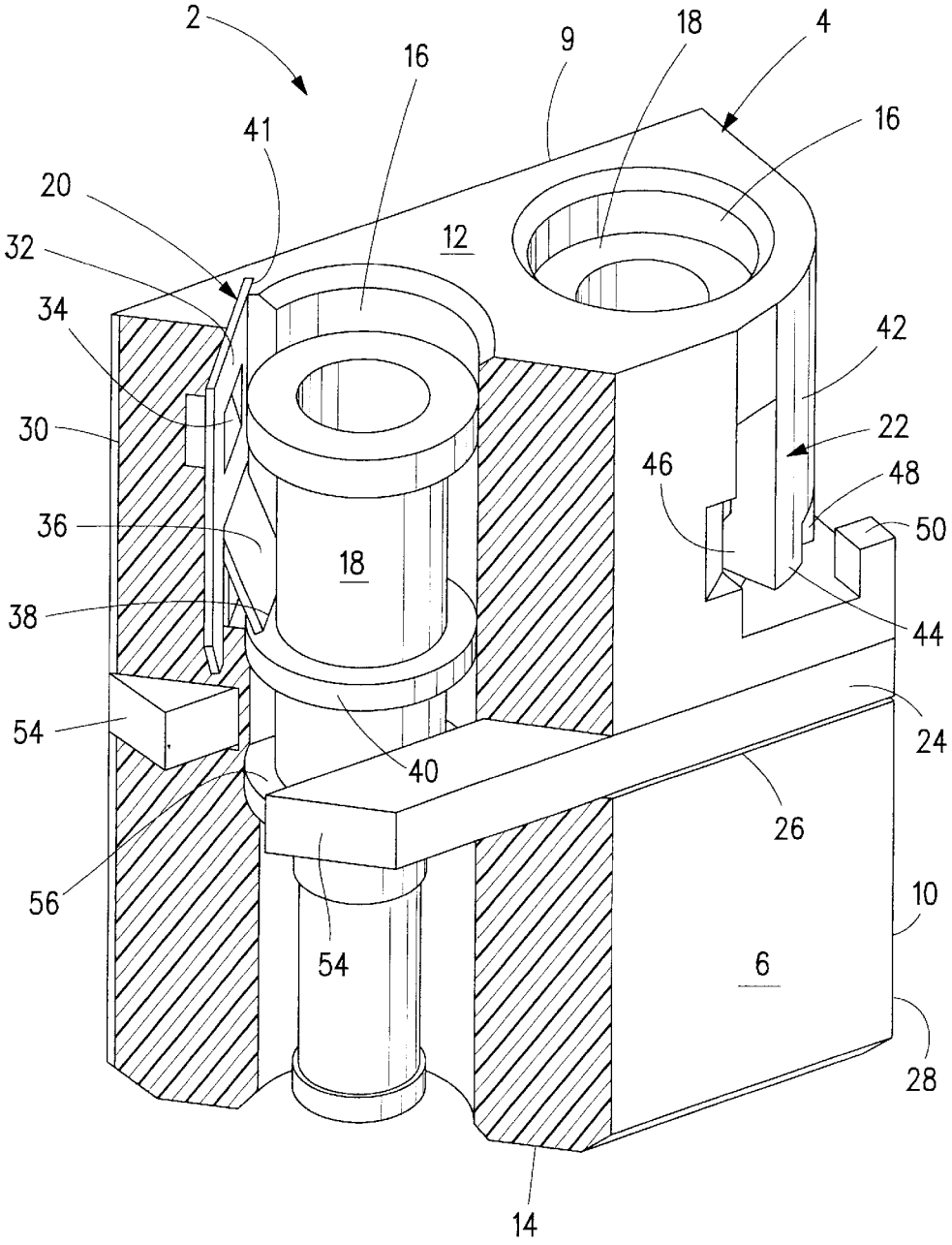
FIG. 2 is a partially cutaway side perspective view of the electrical connector of FIG. 1.

With reference now to FIG. 2, the primary retention members 20, 22 will be described in greater detail. With reference first to primary retention member 20, the primary retention member 20 is a stamped and formed piece of flat metal having a body portion 32. A locking lance 34 is sheared out of the body 32 in order to retain the retention member 20 within terminal block 4. Additionally, a resilient retention arm 36 is also sheared from the body 32 and folded so that a free end 38 extends into passageway 16. The resilient retention arm 36 is constructed such that as the terminal 18 is inserted into the housing, the retention arm 36 will deflect a shoulder 40 of the terminal 18 passes by and then resile therebehind to prevent removal of the terminal 18.

The primary retention member 20 is disposed within a channel 41 that is molded into the terminal block 4. The primary retention member 20 is disposed between the passageway 16 and the corner 30 defined by side walls 9 and 8. As can be seen, the primary retention member 20 is relatively thin and takes up a minimum amount of space, thereby making it particularly useful in connectors having relatively thin side portions between the terminal passageways 16 and an adjacent side 9. It is also envisioned that the body 32 and the associated retention arm 36 could be curved to more closely comply with the shape of the passageway 16 when cylindrical terminal 18 is used. Note, non-cylindrical passageways may be formed and the primary retention member may be disposed along the side wall.

Figure 4:
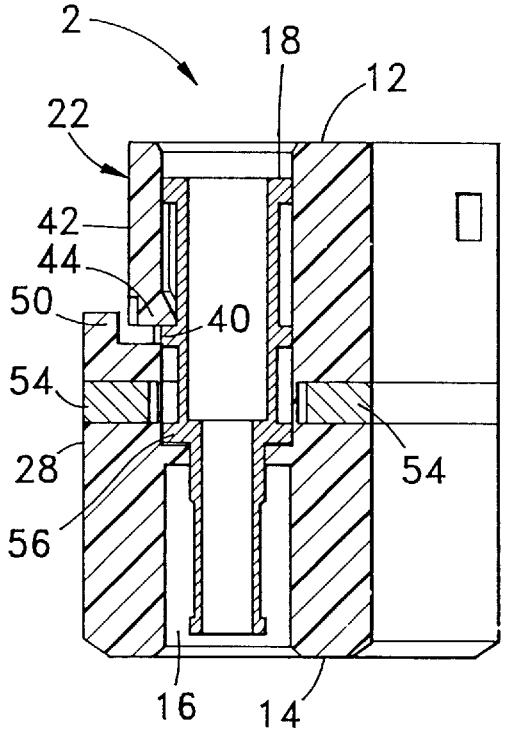
FIG. 4 is a sectional view of the connector of FIG. 1 taken along line 4—4.

With further reference to FIG. 2, a further primary retention member 22 will be described in detail. The primary retention member 22 is a conventionally configured and integrally moulded member with the terminal block 4. Primary retention member 22 includes a resilient arm 42 suspended in cantilevered fashion and extending generally from opposing end wall 12 towards a free end 44. A latch 46 is formed at the free end 44 and extends into the passageway 16. The latch 46 is configured to allow a shoulder 40 of the terminal 18 to pass during insertion and then when the latch arm 42 resiles back to prevent withdraw of the terminal. This is best seen in FIG. 4. Furthermore, at the free end 44 is a notch 48 opposite the latch 46. Also, behind the free end 44 is a post 50 that prevents overstress of the primary retention member 22.

The retention member 22 is formed between the terminal receiving passageway 16 and the corner 28 defined by outer side walls 6 and 10. As can be seen, in the vicinity of the resilient arm 42, a portion of the terminal block 4 at the corner 28 has been removed. This enables the post 50 to be easily formed behind the resilient arm 42. However, a primary retention member 22 such as described above and the over-stressed post 50 may be incorporated anywhere along housing where this desired prevent damage to the primary retention member 22 by way of overstressing. This is especially applicable where the side walls are relatively close to the terminal receiving passageway 16.

Figure 3:
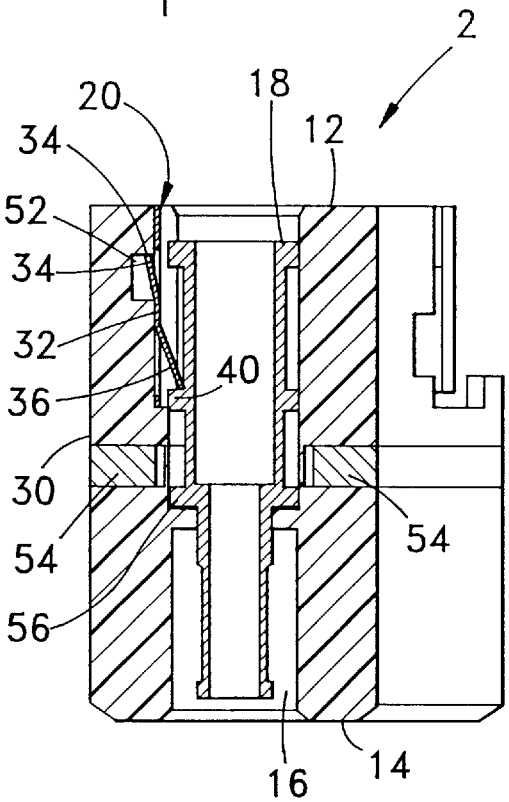
FIG. 3 is a sectional view of the electrical connector of FIG. 1 taken along line 3—3.

With reference now to FIGS. 3 and 4, sectional views are shown that illustrate how the primary retention members 20, 22 interact with the terminals 18 when they are received within passageways 16. As can be seen in FIG. 3, retention arm 36 of the body 32 extends into the passageway 16 to fit behind the shoulder 40. Locking lance 34 is further received within a cavity 52 to prevent removal of the retention member 20. With reference now to FIG. 4, resilient arm 44 is shown cantilevered downward from the end wall 12 to a free end 44 which fits behind the shoulder of the terminal 18. Overstress post 50 is shown behind the free end 44 such that excessive outward deflection of the resilient arm 42 will be prevented by way of the post 50 which is located behind the free end 44.

With reference to FIGS. 1–4, it can advantageously be seen by locating the primary retention members 20, 22 in the corners 28, 30 that are in the vicinity of the passageways 16, more material of the terminal block 12 is available. Furthermore, the secondary locking member 24 that is inserted into the slot 26 includes a pair of arms 54 defining a U-shaped structure such that the arms 54 fit on either side of the terminal behind a second shoulder 56 thereof.

Figure 5:
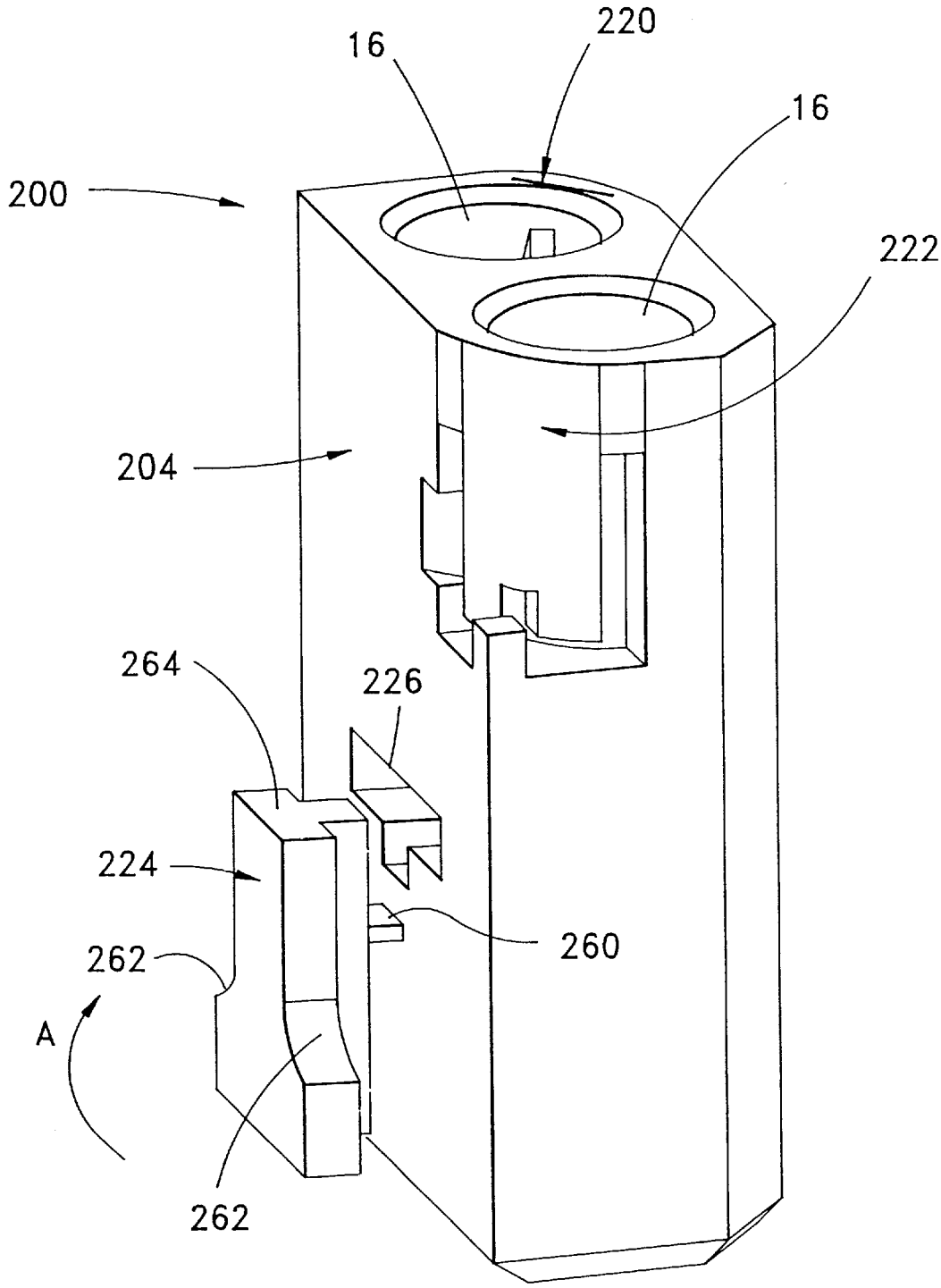
FIG. 5 is side perspective view of an alternative embodiment of an electrical connector according to the present invention.

With reference now to FIG. 5, a second embodiment of the connector shown in FIGS. 1–4 generally at 200. The second embodiment 200 also includes a terminal block 204 and primary terminal retaining members 220, 222. Basically, the second embodiment is generally identical to the first embodiment with the exception of a different secondary locking member 224. In the second embodiment, the secondary locking member 224 is a key-like member integrally moulded to the terminal block 204 by way of a frangible portion 260. The secondary locking member 224 is to be received within a cavity 226 that is located between terminal receiving passageways 16 such that shoulders 262 will co-operate with the shoulders 56 (not shown in FIG. 5). As a result of rotating the secondary locking member 224 in the direction of arrow A, the secondary locking member 224 is inserted into the cavity 226 free end 268 first. The act of rotation in the direction of arrow A brakes the frangible portion 260 and enables the secondary locking member 224 to be properly seated within the terminal block 204.

Figure 6:
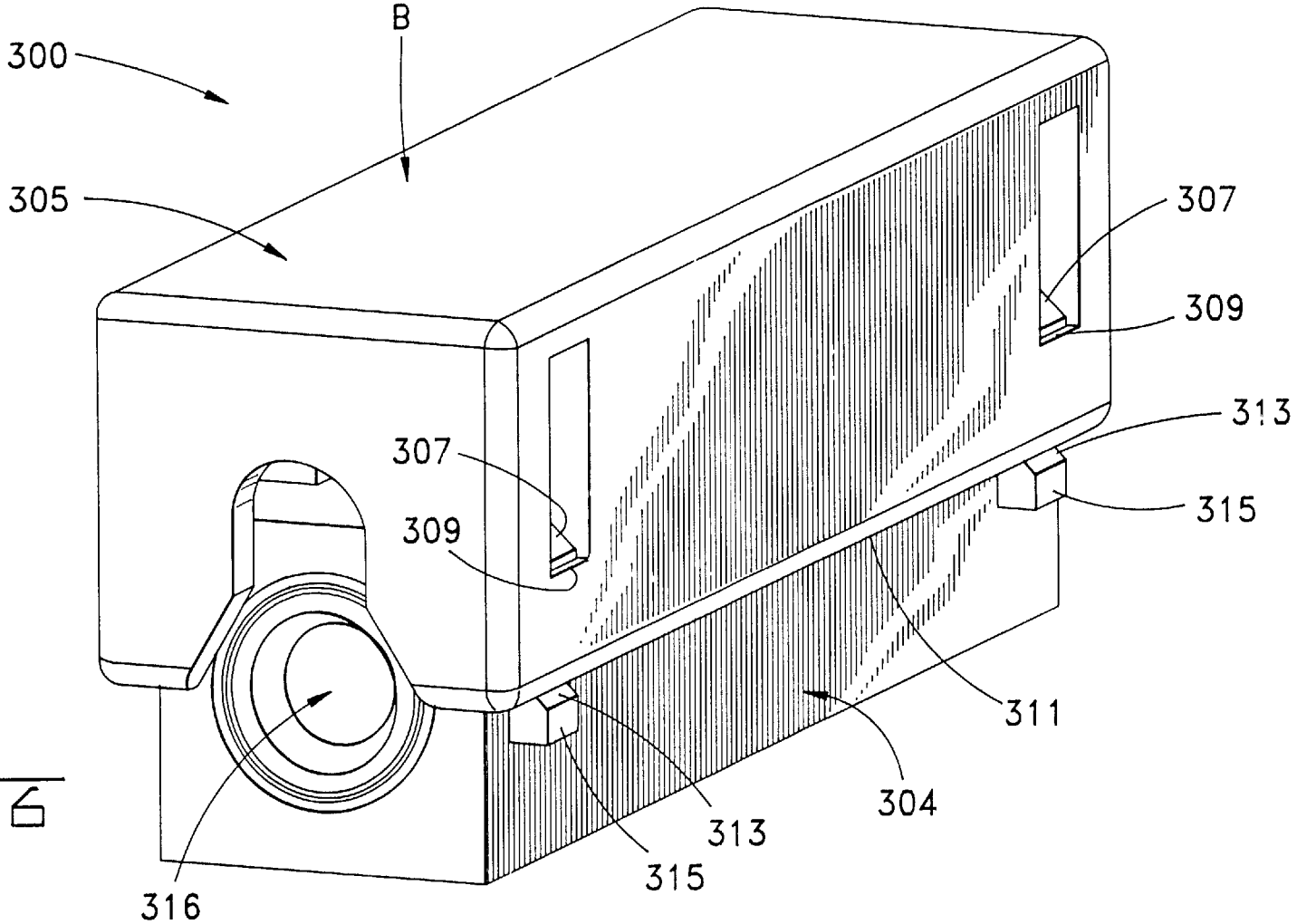
FIG. 6 is an end perspective view of yet another alternative embodiment of a connector according to the present invention, particularly suited for fibre optic applications.

Still yet another alternative embodiment of a connector incorporating the present invention is shown at 300 in FIG. 6. The connector 300 includes a terminal block 304 and a cover 305. The connector 300 is shown in a pre-assembled position where first latches 307 engage ledges 309 of the cover 305 such that terminals 318 (seen in FIG. 9 and in this case fibre optic terminals) can be inserted into the terminal receiving passageway 316. Once the terminals 318 are inserted in the passageway 316, the cover 305 can be pushed downward in the direction of arrow B such that a lower edge 311 of the cover 305 travels over camming surfaces 313 of second latches 315 until the latches 315 engage the surfaces 309. In order to achieve optimum resiliency of the cover 305, it is possible to tailor the resiliency of the lower edge 311 in any number of ways such as creating independent latches, thinner webs of material within the cover or slices in the cover 305 that would enable a portion to be deflected more freely.

Figure 7:
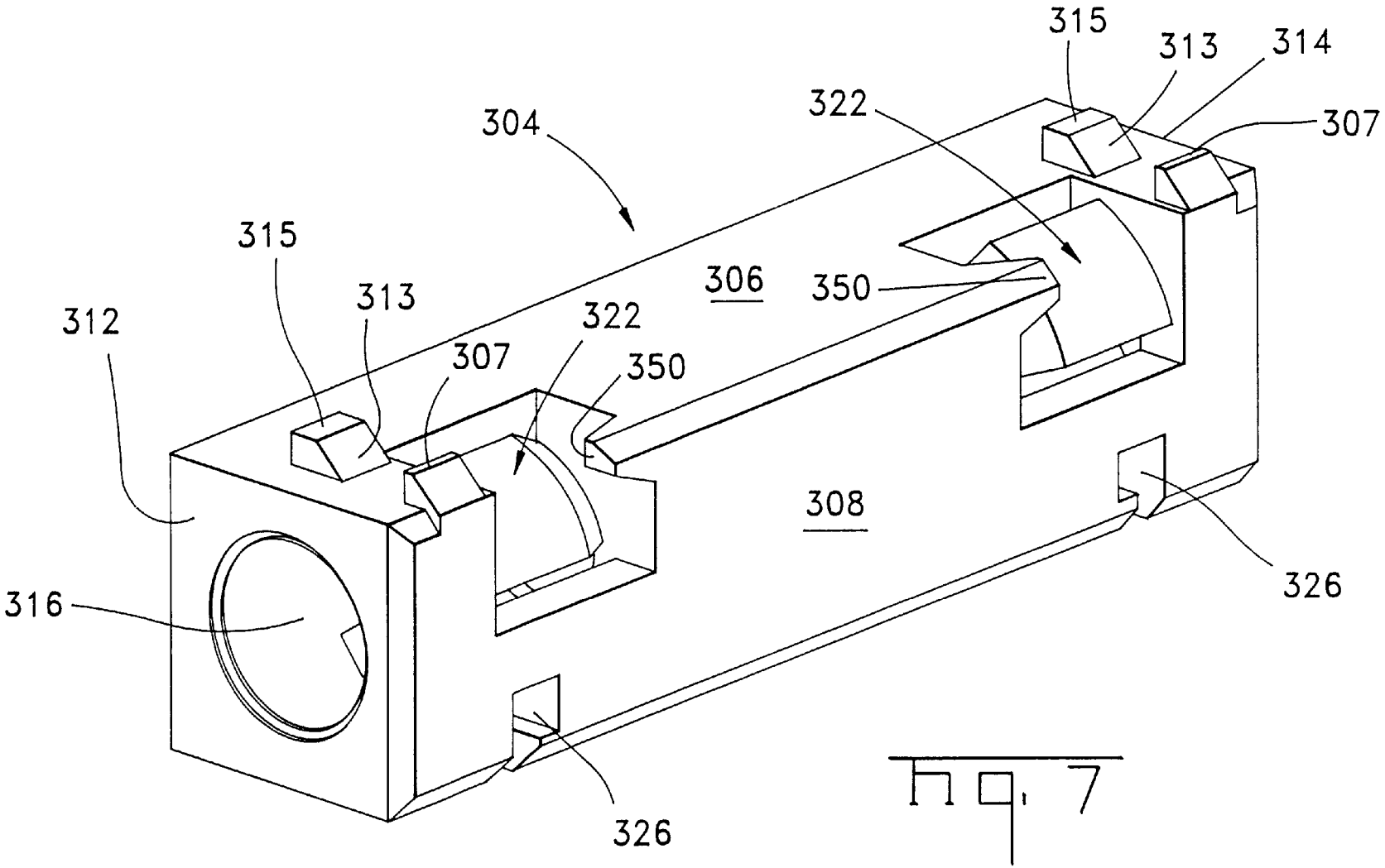
FIG. 7 is an end perspective view of a terminal block of the connector shown in FIG. 6.
Figure 7:
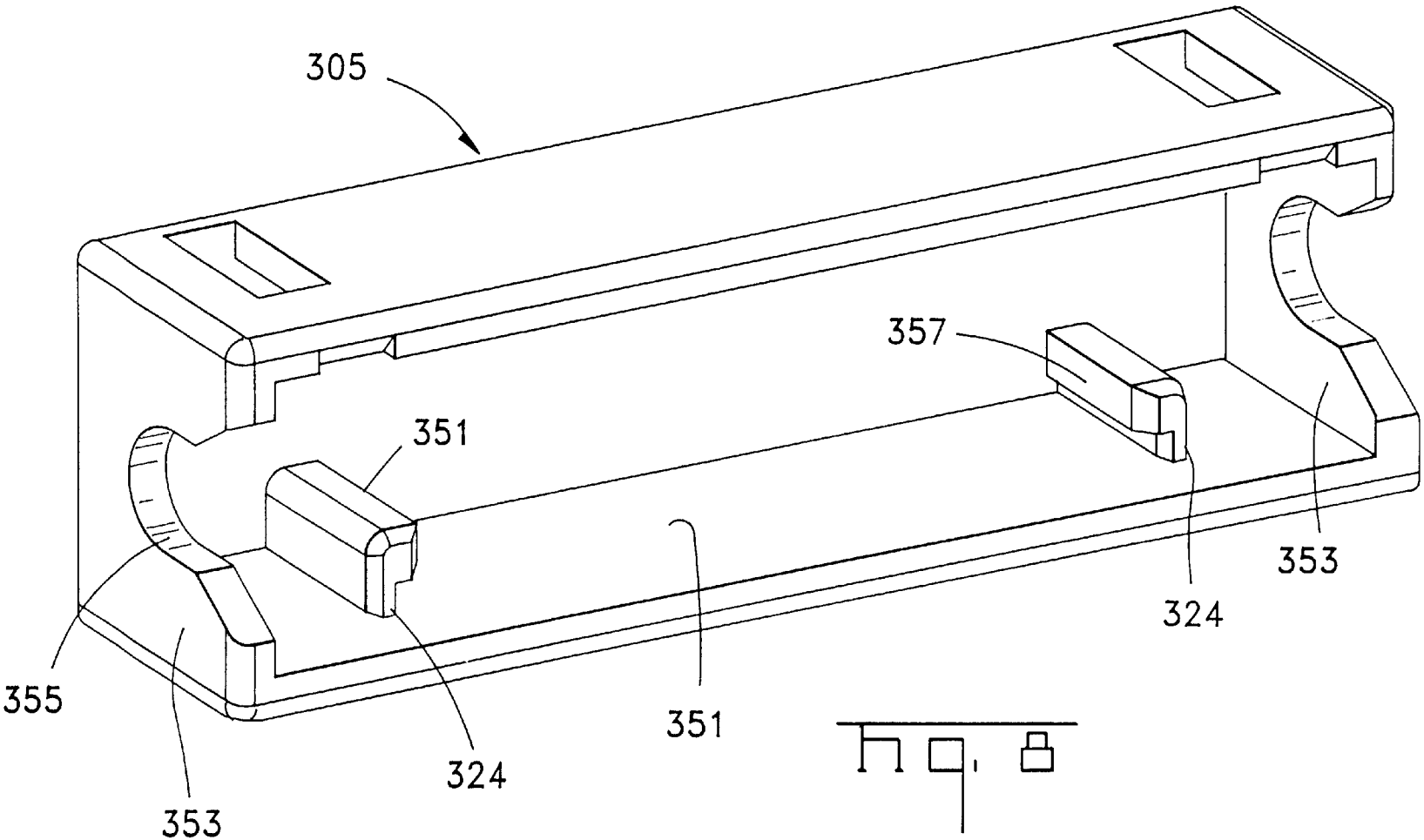

With reference now to FIG. 7, the terminal block 304 will be described in greater detail. The terminal block has outer walls 306, 308 and opposing end walls 312, 314. Primary retention members 322 are disposed along the passageway 316 at the corner defined by the intersection of walls 306, 308. These primary retention members 322 are integrally moulded and resiliently deflectable latch members that correspond generally to those described above. Furthermore, an over-stress post 350 is included to prevent damage to the primary retention member 322 during insertion of the terminal 318. Slots 326 are constructed to extend into the terminal block 304 from wall 308 and be in communication with the terminal receiving passageway 316 such that secondary locking may be provided.

Figure 9:
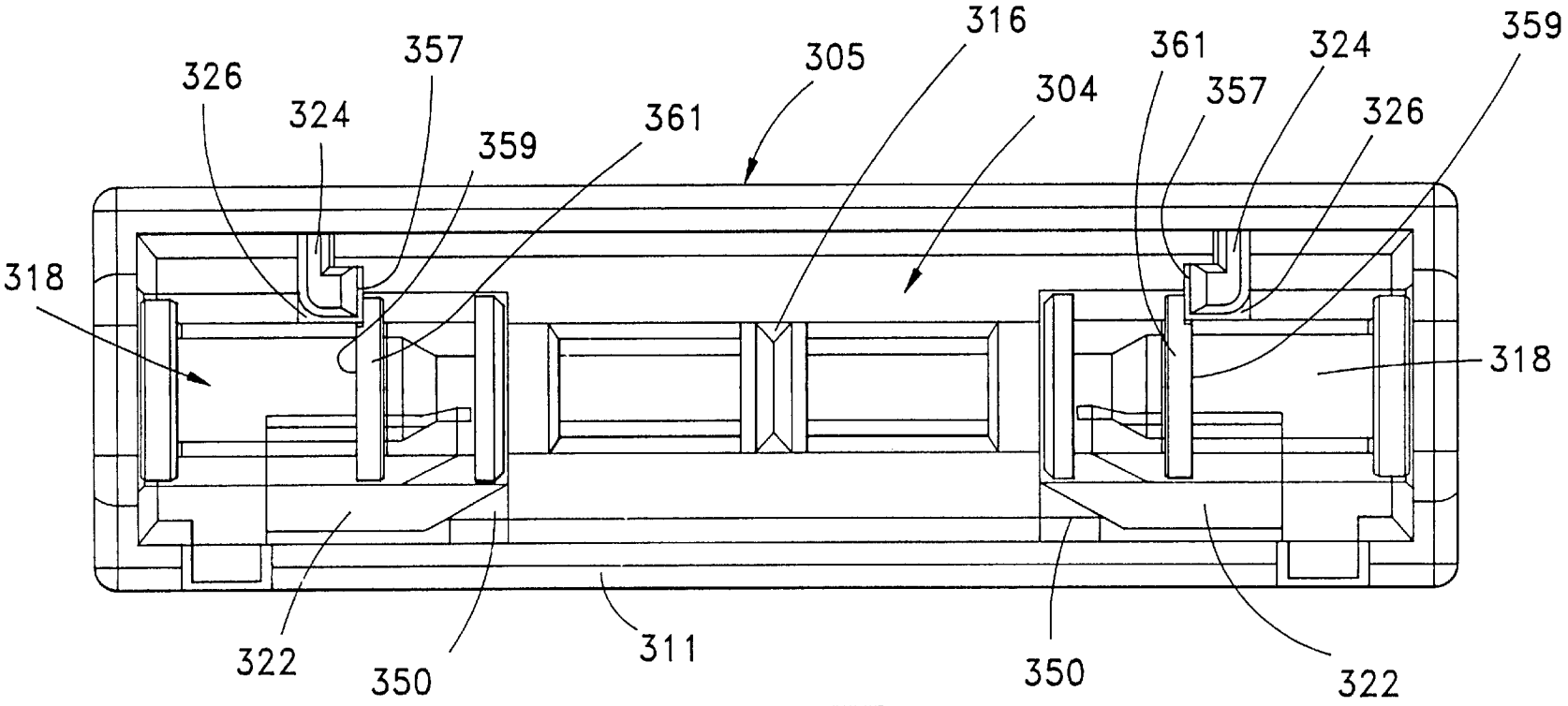
FIG. 9 is a top cut-away view of the assembled connector of FIG. 6.

With reference now to FIG. 8, the cover 305 will be described in greater detail. The cover 305 is of shell-like construction having an open bottom wall 351 wherein the terminal block 304 would be telescopically received. The cover 305 has partially closed end walls 353 with an open cutout 355 provided to allow clearance for the trailing leads that would extend from the terminals 318 positioned within the terminal block 304 when the connector 300 is in the fully assembled state with the surface 309 being engaged by the second latches 315. Additionally, within the interior of the cover 305 are secondary locking members 324 which will be received within the slots 326 as the cover 305 and terminal block 304 are assembled. One especially advantageous feature of this construction is when the connector 300 is used as a splice connector for two abutting fibre optic terminals 318, the distances within the connector can be accurately controlled. This is because each of the secondary locking members 324 include a face 357 that would abut a shoulder 361 of a ferrule and these faces 357 are produced in the same mould. This is best seen in FIG. 9 where the faces 357 are abutting rear surfaces 359 of the shoulders 361 of the fibre optic terminals 318.

Therefore, advantageously, primary retention has been provided for a connector having relatively thin sections between terminal receiving passageways and outer side walls of a terminal block. This is accomplished by either locating the primary terminal retention members and the corners defined by the side walls that are in the vicinity of the terminal receiving passageways, or by providing a primary retention member that is stamped and formed form thin sheets of material and received within the terminal block or by enhancing the structural integrity of a primary locking member by providing overstress protection thereto.

We claim:

1. A connector for receiving terminals therein, the connector comprising: a terminal block having outer walls and opposing end walls, a terminal receiving passageway extending between the opposing end walls for receiving a terminal therein, a channel which extends from a respective end wall toward the opposing end wall, a portion of the channel intersecting with the terminal receiving passageway to provide an opening therebetween, and a primary retention member disposed in the channel having a locking lance that cooperates with a recess formed in the channel to maintain the primary retention member in the channel and having a resilient retention arm extending into the terminal receiving passageway through the opening, the resilient retention arm cooperates with the terminal to retain the terminal in the terminal retention passageway, wherein the primary retention member is formed from a generally flat plate and includes a body set in the channel of the terminal block and the resilient retention arm extends from the body into the passageway.

2. The connector of claim 1, wherein the primary retention member is stamped and formed from a thin metal sheet and is received in the channel of the terminal block located along the passageway.

3. The connector of claim 2, wherein the outer walls are joined to form a corner, where the primary retention member is disposed between the corner and the passageway.

4. The connector of claim 1, wherein the channel is formed in the terminal block between the terminal receiving passageway and a corner defined by two side walls of the terminal block.

5. A connector for receiving terminals therein, the connector comprising: a terminal block having a terminal receiving passageway for receiving a terminal therein, and a primary retention member disposed along the terminal receiving passageway, the primary retention member having a resilient retention arm extending into the passageway to retain the terminal therein, wherein the resilient retention arm extends to a free end and the terminal block includes a post behind the free end to prevent over stressing of the resilient retention arm.

6. The connector of claim 5, wherein the primary retention member is integrally molded with the terminal block.

7. The connector of claim 5, wherein the primary retention member is a stamped and formed metal member.

8. A connector for receiving terminals therein, the connector comprising: a terminal block having outer side walls and opposing end walls with terminal receiving passageways extending therethrough, a primary retention member disposed along at least one respective passageway that includes an integrally molded resilient latch arm that extends into the at least one respective passageway to prevent withdrawal of the inserted terminal, wherein the terminal block includes a post located behind the resilient latch arm to prevent over stress.

9. The connector of claim 8, wherein the outer side walls intersect to define a corner and at least one primary retention member is disposed between the respective passageway and the corner.

10. The connector of claim 8, wherein the latch arm includes a notch which is in alignment with the post.

* * * * *